US005435255A

United States Patent [19]

Elseser et al.

[11] Patent Number: 5,435,255

[45] Date of Patent: Jul. 25, 1995

[54] MODULAR SAFE DEPOSIT BOX ASSEMBLY

[75] Inventors: John W. Elseser, Canton; Ramon A. Nero; Alan J. Rozlosnik, both of Louisville, all of Ohio

[73] Assignee: Diebold, Incorporated, Canton, Ohio

[21] Appl. No.: 62,915

[22] Filed: May 14, 1993

[51] Int. Cl.[6] ..... E05G 1/00

[52] U.S. Cl. ..... 109/56; 109/67; 109/79; 312/111; 312/257.1

[58] Field of Search ..... 109/50, 53, 56, 67, 109/74, 85, 77–79; 312/111, 198, 199, 257.1

[56] References Cited

U.S. PATENT DOCUMENTS

| | | | |
|---|---|---|---|
| 361,408 | 4/1887 | Gross | 109/56 |
| 809,497 | 1/1906 | Dick . | |
| 1,421,770 | 7/1922 | Freyberg et al. . | |
| 1,491,786 | 4/1924 | Bruckshaw et al. | 109/56 |
| 3,837,299 | 9/1974 | McClellan . | |
| 3,970,010 | 7/1976 | Cantley . | |
| 4,073,554 | 2/1978 | Oder et al. . | |
| 4,194,453 | 3/1980 | Cutter . | |
| 4,423,687 | 1/1984 | Serra . | |
| 4,528,916 | 7/1985 | Knight . | |
| 4,557,416 | 12/1985 | Stahl et al. | 109/56 X |
| 4,592,601 | 6/1986 | Hlinsky | 312/111 |
| 4,608,932 | 9/1986 | Bohland et al. | 109/53 X |
| 4,728,158 | 3/1988 | D'Elia et al. | 312/257.1 X |
| 4,947,766 | 8/1990 | Collier, Jr. . | |
| 4,962,710 | 10/1990 | Habicht et al. | 109/79 |
| 5,048,902 | 9/1991 | Daly | 312/257.1 X |
| 5,060,582 | 10/1991 | Salzer | 109/74 X |

*Primary Examiner*—Peter M. Cuomo
*Assistant Examiner*—Suzanne L. Dino
*Attorney, Agent, or Firm*—D. Peter Hochberg; Mark Kusner; Michael Jaffe

[57] ABSTRACT

A safety deposit box storage structure comprising: a housing formed from continuous metal sheet, the housing having a back wall and spaced apart side walls. At least one inwardly projecting ridge extends along the inner surface of each side wall. A top wall and a bottom wall are secured to the housing to form a box structure having an open front end. At least one vertical partition is disposed between and parallel to the side walls; the vertical partition being generally flat, and having at least one corrugation formed therein. Each corrugation has a ridge projecting from each side of the partition. A plurality of spaced-apart slots are formed in the ridges. The slots are generally parallel to the top and bottom wall: A plurality of horizontal shelves are provided having lateral edges dimensioned to be received in the slots, the vertical partitions and horizontal shelves defining compartments within the box structure to receive a security box. A door frame is fixedly connectable to the open front end of the housing. The door frame includes a plurality of lockable doors equal in number to the number of compartments defined within the housing.

20 Claims, 13 Drawing Sheets

28
62
66
74
62
60
62
20
72
28
64
72
32
64
66
26
74
"C"
74
72
112
32
100
82
80
106
82
70
80
82
50
34
24
12
34
32
126
224
156
120
152
154
158
224
140
130
142
122
220
14
142
224
166
124
174
172

152
14
120
64
94
94
"C"
60
62
12
94
10
28
22
154
100
64
220
90
92
106
100
110
212
184
86
100
106
90
112
140
90
108
52
92
110
50
86
130
90
220
100
50
154
"C"
62
64
152
122
94
94
70
80
66
84
82
94
28
20

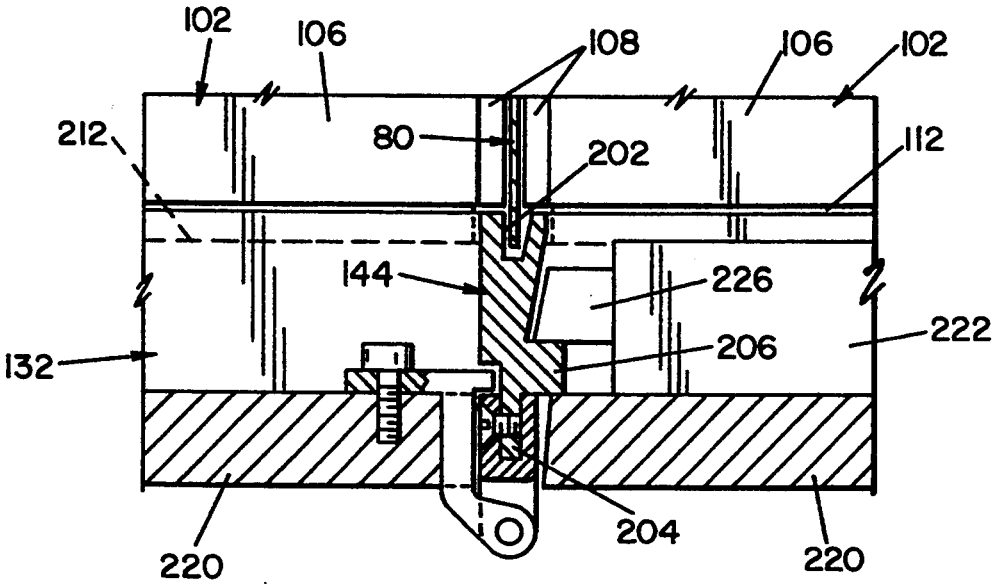
FIG. 13A
FIG. 13
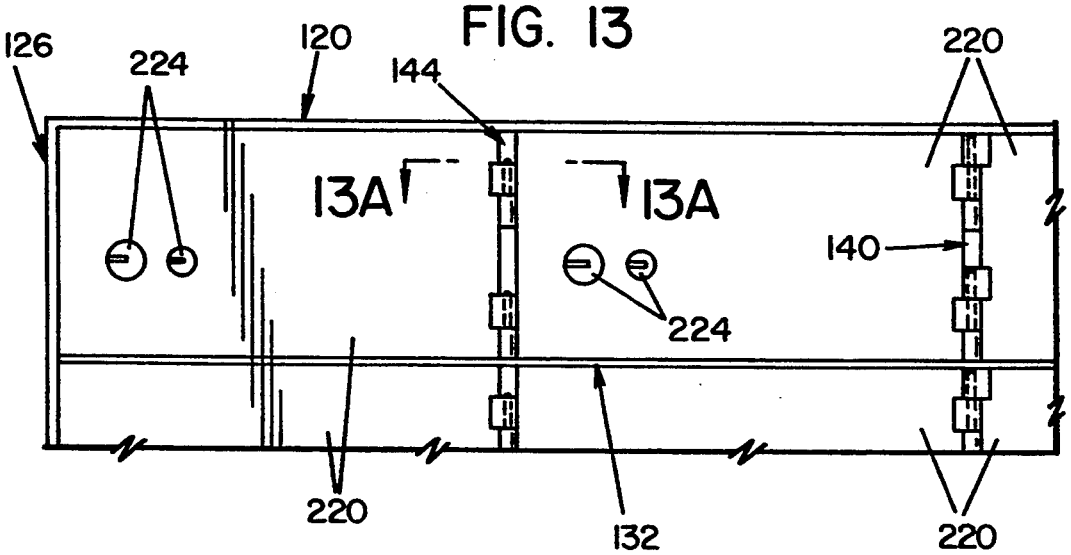

MODULAR SAFE DEPOSIT BOX ASSEMBLY

FIELD OF THE INVENTION

The present invention relates to safety deposit box systems, and more particularly, to an improved modular-type structure for a safety deposit box system.

BACKGROUND OF THE INVENTION

Safety deposit box systems are well known and may be found within the vaults of most financial institutions. Safety deposit box systems are basically comprised of a compartmental housing wherein each compartment within the housing receives a storage box. Means are provided for locking each storage box within its respective compartment. Most financial institutions prefer a plurality of sizes of safe deposit boxes for rental to customers at differential rates. Accordingly, safe deposit box systems are available in a plurality of different box sizes or a combination of box sizes, e.g. 3"×5" boxes, 3"×10" boxes, 5"×5" boxes, 5"×10" boxes or 10"×10" boxes, etc.

To accommodate demands by financial institutions for a particular size safety deposit box or groupings of different sized safety deposit boxes, it has been known to provide modular safety deposit box systems. With such systems, a limited number of standardized components, i.e. shelves and dividers, are used to create the different sized compartments within a standard housing. Many such systems are typically assembled through tabs on components extending into complimentary slots or notches in other components. Still other systems are assembled by welding the standardized components in place. With respect to the former type of assembly, because the respective components are basically not fastened to each other, the components must be made of fairly rigid material to provide the structural stability lost through the loose fitting components. With case assemblies which are welded together, thinner material may be utilized to form the compartments, but the labor costs to assemble a security deposit box system are generally undesirable.

The present invention overcomes these and other problems and provides a modular safety deposit box system which utilizes components formed of relatively thin metal sheeting which are secured together by adhesive material or spotwelding to form a rigid, sturdy safety deposit box system.

SUMMARY OF THE INVENTION

In accordance with the present invention, there is provided a safety deposit box storage structure comprising a casing formed from continuous metal sheet, the casing having a back wall and spaced apart side walls. At least one inwardly projecting ridge extends along the inner surface of each side wall. A top wall and a bottom wall are secured to the casing to form a box structure having an open front end. At least one vertical divider is disposed between and parallel to the side walls, the vertical divider being generally flat and has at least one corrugation formed therein, which corrugation has a ridge projecting from each side of the divider. A plurality of spaced-apart slots are formed in the ridges, the slots being generally parallel to the top and bottom wall. A plurality of horizontal dividers are provided and have lateral edges dimensioned to be received in slots. The vertical divider and the horizontal dividers define compartments within the box structure to receive a security box. A door frame is fixedly connected to the open front end of the casing. The door frame includes a plurality of lockable doors equal in number to the number of compartments.

An object of the present invention is to provide a safety deposit box system which can be easily assembled and in which different sized compartments may be formed from a minimum number of like parts.

Another object of the present invention is to provide a system as described above wherein the pans are generally stamped from flat sheets of metal material.

Another object of the present invention is to provide a system as described above wherein the pans may be secured to each other by an adhesive material or by spotwelding.

Another object of the present invention is to provide a safety deposit box system as described above which is simple, efficient and economical to manufacture.

Another object of the present invention is to provide a modular safety deposit box system in which a single modular housing structure is employed and compartments of different sizes may be formed within the housing by vertical dividers and horizontal shelves assembled to such housing.

A still further object of the present invention is to provide a system as described above wherein security doors for closing compartments are provided on a door frame assembly which is attachable to the housing.

A still further object of the present invention is to provide a door frame assembly as described above wherein the assembly is formed of standard components and the door sizes may be modified using such components.

These and other objects and advantages will become apparent from the following description of a preferred embodiment of the invention, taken together with the accompanying drawings.

BRIEF DESCRIPTION OF THE DRAWINGS

The invention may take physical form in certain parts and arrangement of parts, embodiments of which are described in detail in the specification and illustrated in the accompanying drawings wherein:

FIG. 13 is a partial, front elevational view of a safety deposit box system illustrating a special hinge/latch post for use in the present invention;

FIG. 13A is an enlarged sectional view taken along line 13A—13A of FIG. 13;

DESCRIPTION OF PREFERRED EMBODIMENT

Figure 1:
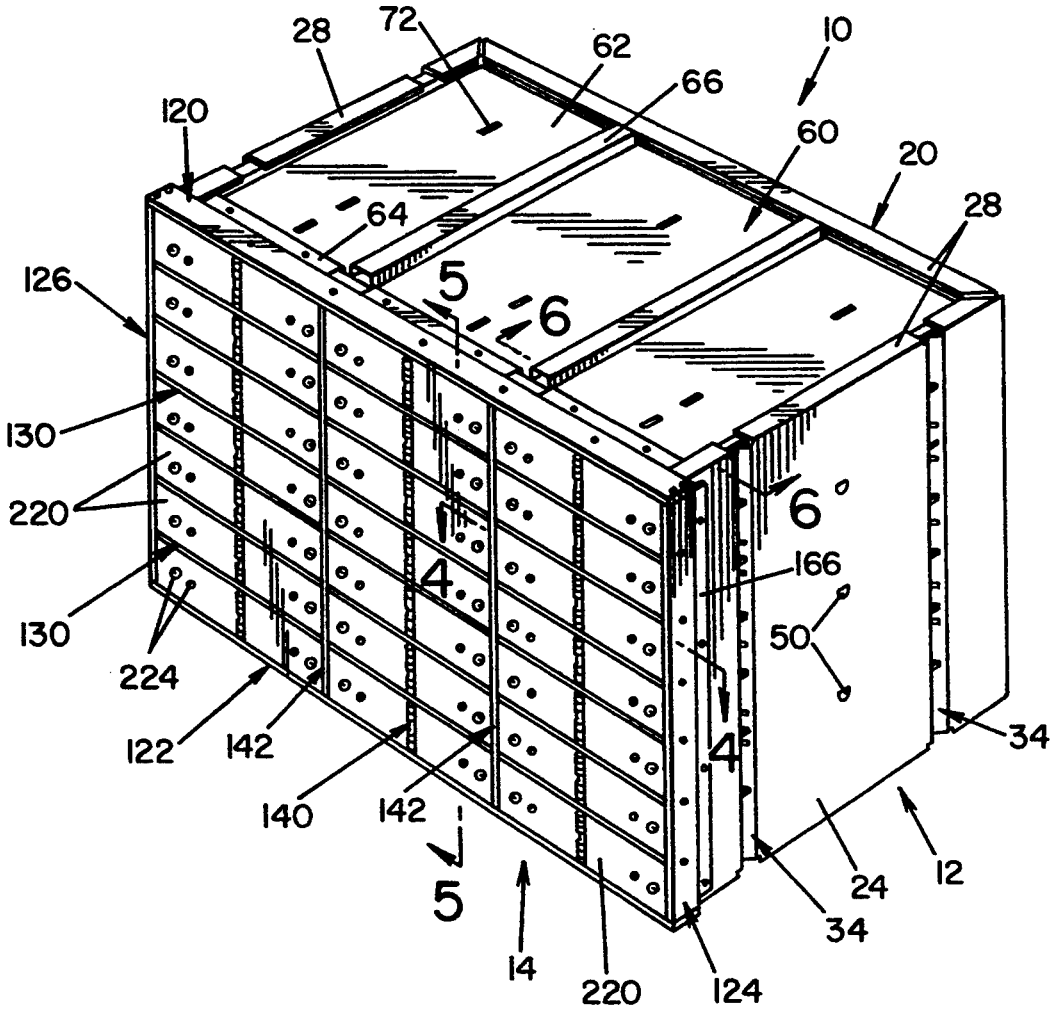
FIG. 1 is a perspective view of a safety deposit box system having a plurality of like size individual compartments, illustrating a preferred embodiment of the present invention.

Referring now to the drawings wherein the showings are for the purpose of illustrating a preferred embodiment of the invention only, and not for the purpose of limiting same, FIG. 1 shows a safe deposit box structure 10 illustrating a preferred embodiment of the present invention. Safe deposit box structure 10 is basically comprised of a box-like housing 12 having an open front end to which is attached a door assembly 14.

Figures 3, 3A:
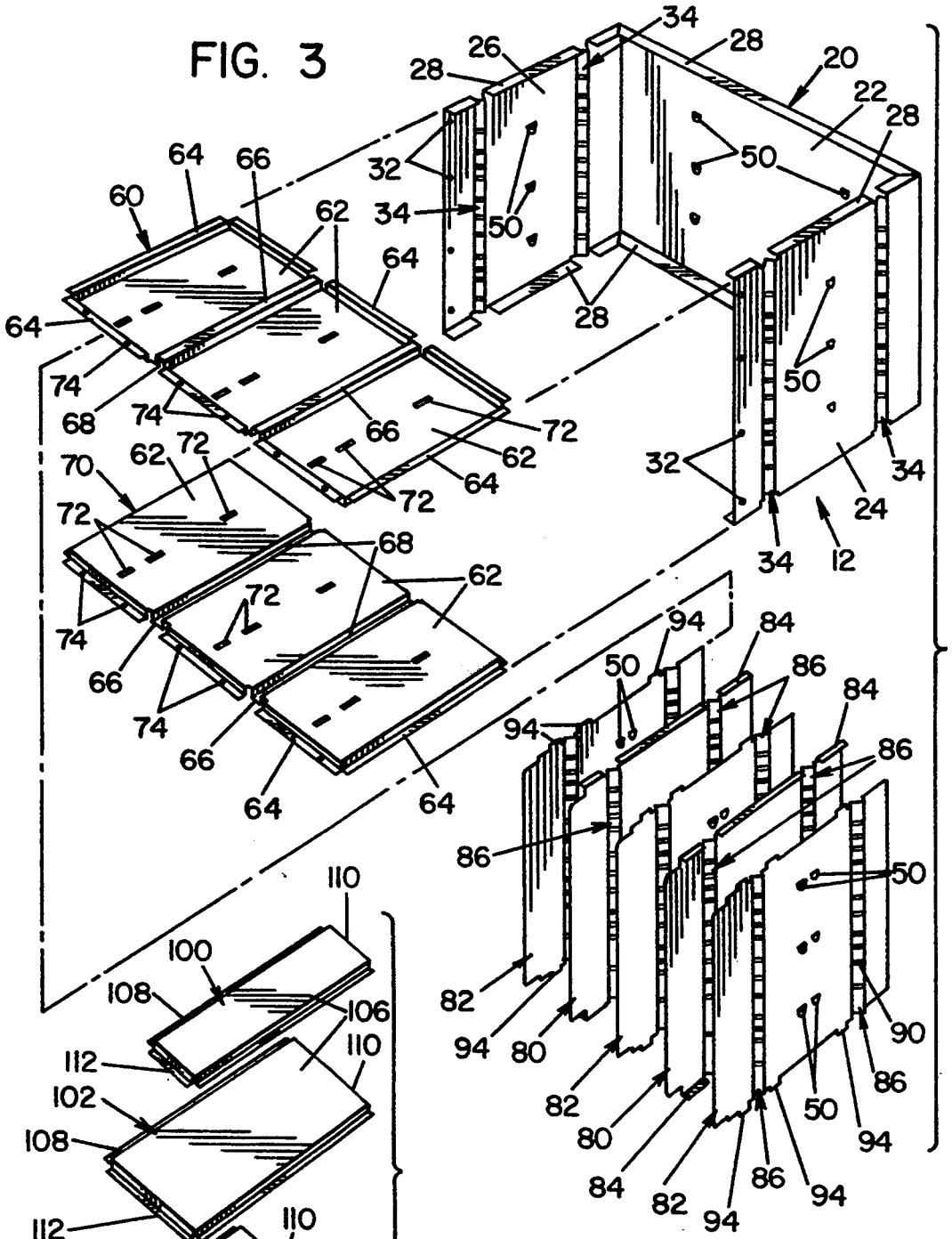
FIG. 3 is an exploded view of basic components utilized in forming the system housing.
FIG. 3A is a perspective view of shelves which may be utilized in forming a safety deposit box system according to the present invention.

Housing 12, best seen in FIG. 3, is basically comprised of a U-shaped frame 20, and a top wall 60 and a bottom wall 70 which are attached hereto. In the embodiment shown, frame 20 is formed of a single sheet of material and is shaped to define a back wall 22, and opposed side walls 24, 26 which are generally parallel to each other. Frame 20 may, however, be a three piece construction (i.e., back wall 22 and side walls 24, 26) which is preassembled into the shape shown in the FIG. 3. The upper and lower ends of the back wall 22 and side walls 24, 26 are bent inward to define a lip 28 along the upper and lower edges of frame 20.

A plurality of spaced-apart apertures 32 extend to the front edge of each side wall. Apertures 32 are positioned at predetermined locations along the front edges of side walls 24, 26 to aid in assembly of safe deposit box structure 10 as will be described in greater detail below.

Figure 6:
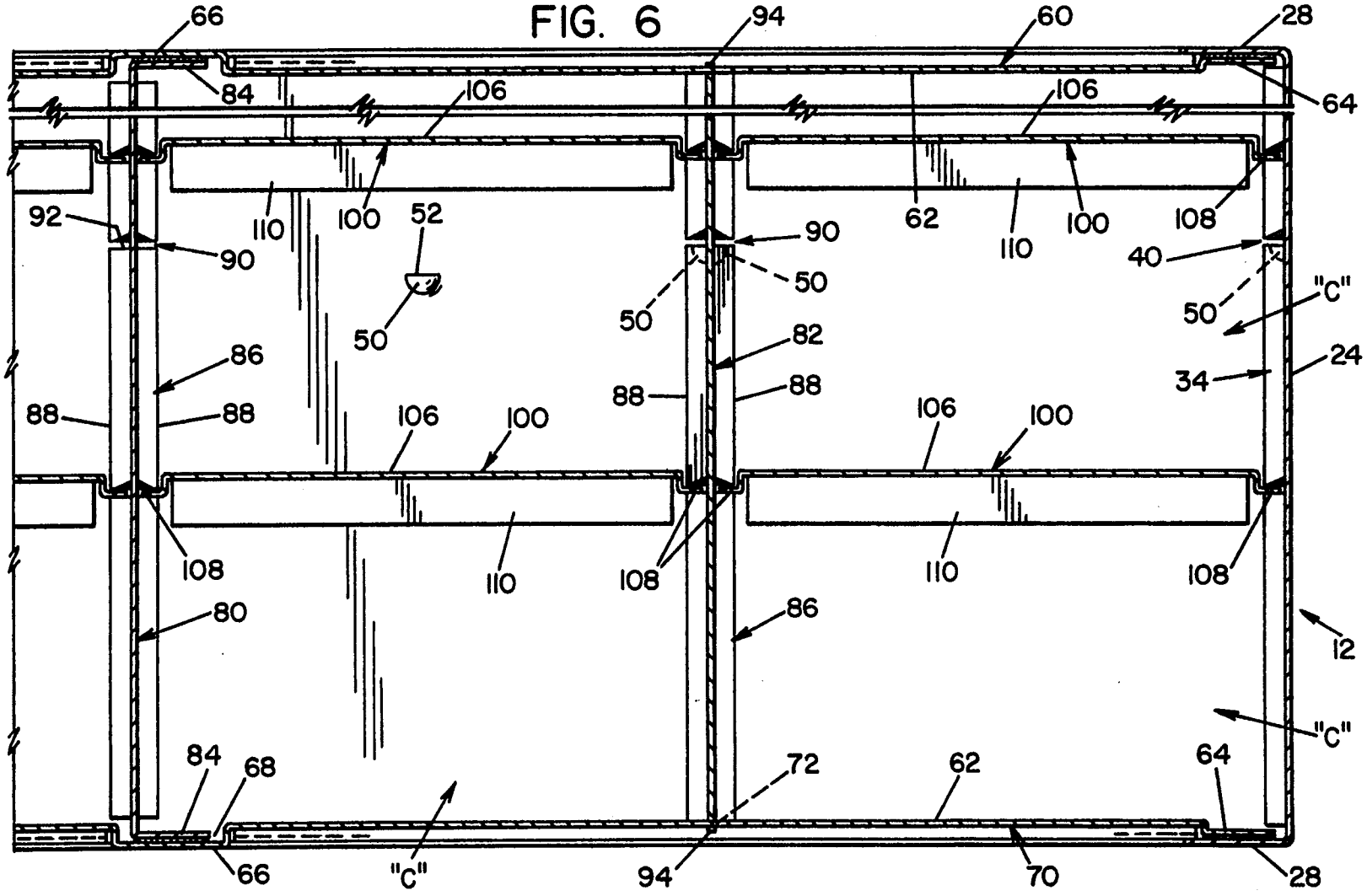
FIG. 6 is an enlarged sectional view taken along lines 6—6 of FIG. 1.
Figure 7:
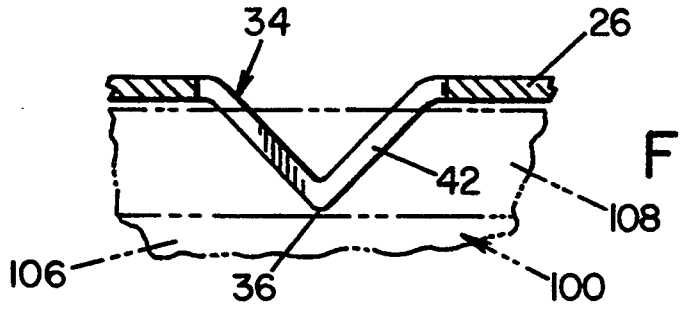
FIG. 7 is an enlarged sectional view through one side wall of the system housing showing a shelf mounting surface.
Figure 8:
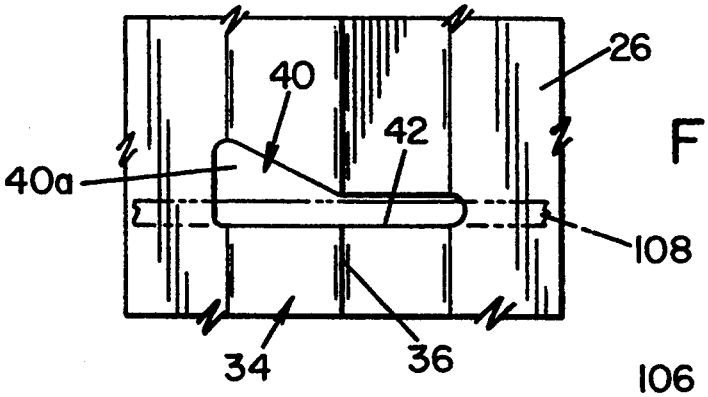
FIG. 8 is an enlarged elevational view of the mounting surface shown in FIG. 7.

In the embodiment shown, each side wall 24, 26 includes a pair of elongated, side-by-side ridges 34 which extend from the top to the bottom of side walls 24, 26. Ridges 34 are generally parallel to each other, and parallel to back wall 22. As best seen in FIGS. 7 and 8, each ridge 34 is generally V-shaped in cross section, and has an apex 36 which projects toward the opposing side wall. Each ridge 34 includes a plurality of spaced-apart notches 40. Each notch 40 is formed to have a flared opened end 40*a* facing the opened end of housing 12, as best illustrated in FIG. 8. In the embodiment shown in FIGS. 1–6, 11 notches 40 are provided at predetermined locations along each ridge 34, with the notches 40 in each ridge 34 being equal in number and location to the notches 40 in each other ridge 34 formed in side walls 24, 26. Each notches 40 formed in a ridge 34 in side walls 24, 26 define an upward facing, generally V-shaped support surface 42, best seen in FIGS. 7 and 8.

Figure 11:
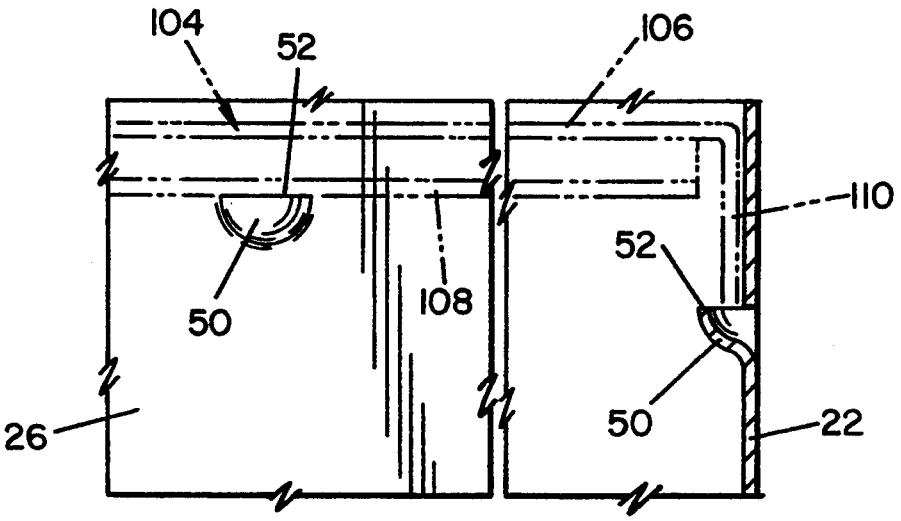
FIG. 11 is an enlarged sectional view showing the configuration of supplemental mounting surfaces according to the present invention.

Side walls 24, 26 and back wall 22 also include a plurality of indentations 50, best illustrated in FIG. 11 which are aligned in rows. As best seen in FIG. 3, indentations 50 are aligned in rows which are generally parallel to each other, and parallel to the ridges 34 formed in side walls 24, 26. In the embodiment shown, side walls 24, 26 and back wall 22 also include a plurality of indentations 50 which are best seen in FIGS. 3 and 11. Each indentation 50, which may be formed by a conventionally-known stamping process, is generally rounded and defines an upward facing, generally planar indentation support surface 52. As seen in the drawings, in the embodiment shown, indentations 50 are arranged in vertical rows, each row containing three (3) spaced-apart indentations 50. As seen in FIG. 3, in the embodiment shown, a row of indentations 50 is provided between and parallel to ridges 34 on each side walls. Two spaced-apart rows of indentations 50 are provided along back wall 22. Indentations 50 are provided at specific locations along side walls 24, 26 and back 22, as will be described in greater detail below.

Referring now to top wall 60 and bottom wall 70 which are best seen in FIG. 3, as indicated above, top wall 60 and bottom wall 70 are provided for attachment to the upper and low ends of frame 20. According to the present invention, top wall 60 and bottom wall 70 are preferably identical components, which are merely oriented in opposite directions for attachment to frame 20. More specifically, top wall 60 and bottom wall 70 are generally comprised of a flat sheet having three raised panels 62 formed therein. Raised panels 62 define a flange 64, which is non-continuous, about the periphery of top wall 60 and bottom wall 70. Between raised panels 62, a pair of generally U-shaped channels 66 are formed, which channels 66 define a generally rectangular groove 68. A plurality of aligned, spaced apart generally rectangular apertures 72 are formed in each panel at predetermined locations thereon. More specifically, rectangular slots 72 are generally aligned along the central line of each panel. A plurality of spaced-apart apertures 74 are formed along one edge of the top wall 60 and bottom wall 70 for use in assembly of the door assembly 14 to the box-like housing 12 as will be described in greater detail below.

Top wall 60 and bottom wall 70 are secured to upper and lower ends of the U-shaped frame 20 to form a box structure, which box structure defines a generally rectangular inter-chamber having an open front end. In this respect, top wall 60 and bottom wall 70 are dimensioned to mate with frame 20 wherein flanges 64 about the periphery of top wall 60 and bottom wall 70 abut with lip 28 formed on the upper and lower ends of frame 20, as best seen in FIG. 6. According to one aspect of the present invention, top wall 60 and bottom wall 70 are preferably secured to frame 20 by means of adhesive bonding material. The adhesive bonding material is preferably applied between flanges 64 on top wall 60 and bottom wall 70 and lip 28 formed on the upper and lower portions of the frame 20. The adhesive bonding material is preferably a quick cure structural adhesive or a double-sided adhesive tape. In this respect, an acrylic structural adhesive sold under the trademark VERSILOK® 201 manufactured by Lord Industrial Adhesives, Erie, Pa. has been found to provide sufficient bonding strength. Top wall 60 and bottom wall 70 may also be secured to frame 20 by conventionally known spotwelding techniques.

Together, frame 20 and top wall 60 and bottom wall 70 form a box-like structure having an open front and defining a generally rectangular cavity therein. According to the present invention, the cavity formed by the box-like structure is to be divided into a plurality of compartments by means of vertical partitions 80, 82 and horizontal shelves 100, 102, 104. Importantly, the number and size of the compartments formed within the box-like structure may vary based upon the position, type and number of partitions 80, 82 and shelves, 100, 102, 104 used, as will be described in greater detail below.

Figure 9:
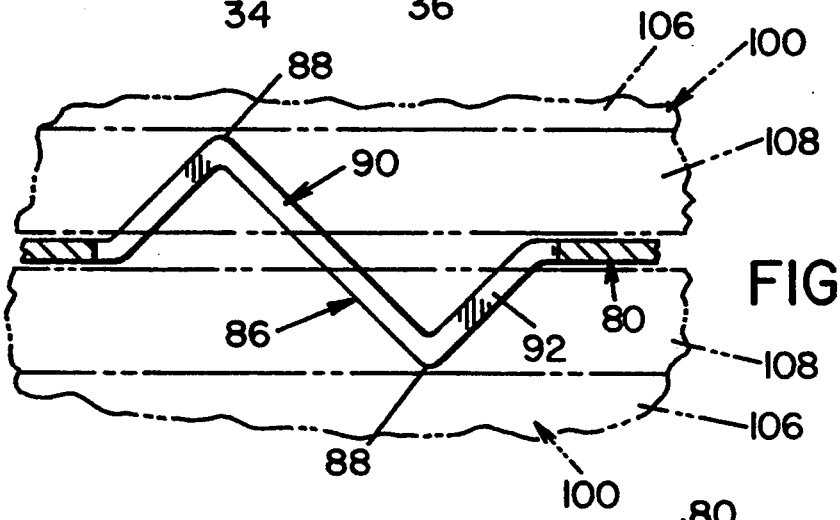
FIG. 9 is an enlarged sectional view of a vertical partition showing shelf mounting surfaces as formed therein.
Figure 10:
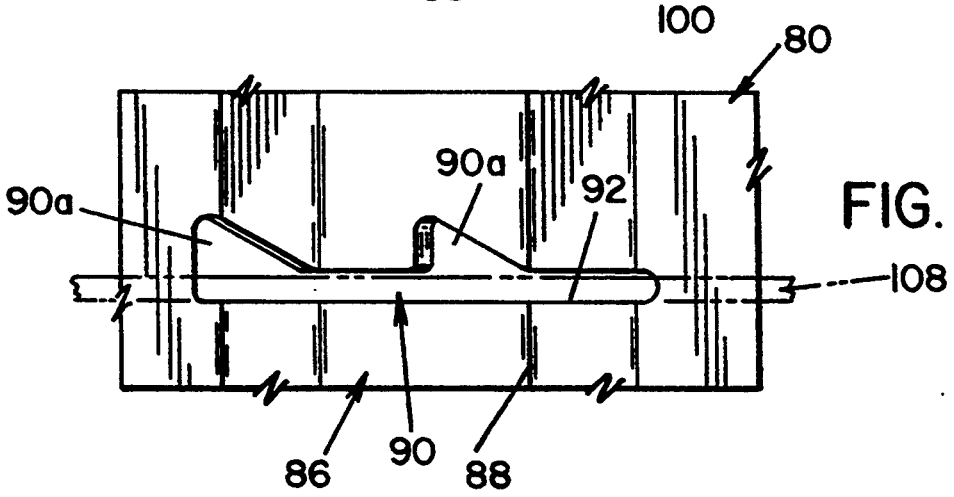
FIG. 10 is a side elevational view of the shelf mounting surface shown in FIG. 9.

Referring now to FIG. 3 and to vertical partitions 80, 82, vertical partitions 80 are provided to be positioned vertically within the cavity defined by the housing 12 and to divide the cavity into equal rectangular spaces. In the Figures, like-numbered vertical partitions are generally identical and interchangeable as will be more fully understood from a further reading of the present specification. In this respect, only one of each type of vertical partition 80, 82 will be described in detail, it being understood that such description applies equally to the other, like-numbered vertical partitions. Vertical partition 80 is generally a rectangular, flat sheet formed to have laterally extending flanges 84 at the upper and lower ends thereof. A pair of side-by-side, generally Z-shaped corrugations 86 which are generally parallel to each other are provided to extend along the surface of vertical partition 80. Each corrugation 86, which is shown in cross section in FIG. 9, includes opposite projecting ridges 88 which extend on opposite sides of vertical partition 80. Ridges 88 project a pre-determined distance from the surface of vertical partition 80. A plurality of spaced apart notches 90 are formed in each corrugation 86 at predetermined locations. As best seen in FIG. 10, the leading end of the notches 90, i.e., the end of notches 90 nearest the open end of the box housing, are enlarged to provide an enlarged opening 90*a* facing the opened end of the box-like housing 12. Notches 90, each define an upward facing notch support surface 92.

According to the present invention, vertical partitions 80 are dimensioned to be positioned within the cavity defined by the box-like housing 12 and to divide such cavity into generally equal sections. In the embodiment shown, flanges 84 on the upper and lower ends of vertical partition 80 are adapted to be received within the groove formed by channels 66 in top wall 60 and bottom wall 70, and to be secured therein preferably by an adhesive bonding material. Vertical partition 80 may also be secured to top wall 60 and bottom wall 70 by conventionally-known spotwelding techniques. In the embodiment shown, vertical partitions 80 are generally inserted during assembly of housing 12. In this respect, vertical partitions 80 are spaced apart from each other and from side walls 24, 26 to divide the chamber defined by housing 12 into three generally equal sections.

Referring now to vertical partitions 82, these partitions are generally similar in most respects to vertical partitions 80 previously discussed. More specifically, each vertical partition 82 is generally formed from a rectangular, flat sheet having generally Z-shaped corrugations 86 (similar to those in vertical partition 80) which are generally parallel to each other and extend along the surface of partition 82. A plurality of spaced-apart notches 90 are formed in each corrugation 86, which notches 90 correspond in shape and position to the notches 90 provided in vertical partitions 80. In addition, vertical partitions 82 also include a plurality of indentations 50. As best seen in FIG. 3, the indentations 50 are arranged in side-by-side parallel rows of three (3) wherein the indentations 50 in one row project to one side of vertical panel 82 and indentations 50 in the other row project to the other side of vertical panel 82. Vertical partitions 82 are provided to be positioned between the previously mentioned vertical partitions 80 and side walls 24, 26 to further divide the chamber into smaller sections. In this respect, partitions 82 are dimensioned to be positioned within the chambers and include tabs 94 on the upper and lower ends thereof to be received within slots 72 formed in the upper wall 60 and lower wall 70 respectively. More specifically, in the embodiment shown, slots 72 are preferably positioned in upper wall 60 and lower wall 70 such that vertical partitions 82 when mounted within the housing divide the chamber within the box structure into six generally equal sections. In this respect, vertical partitions 82 are preferably dimensioned to snap into place within housing 12.

Figure 5:
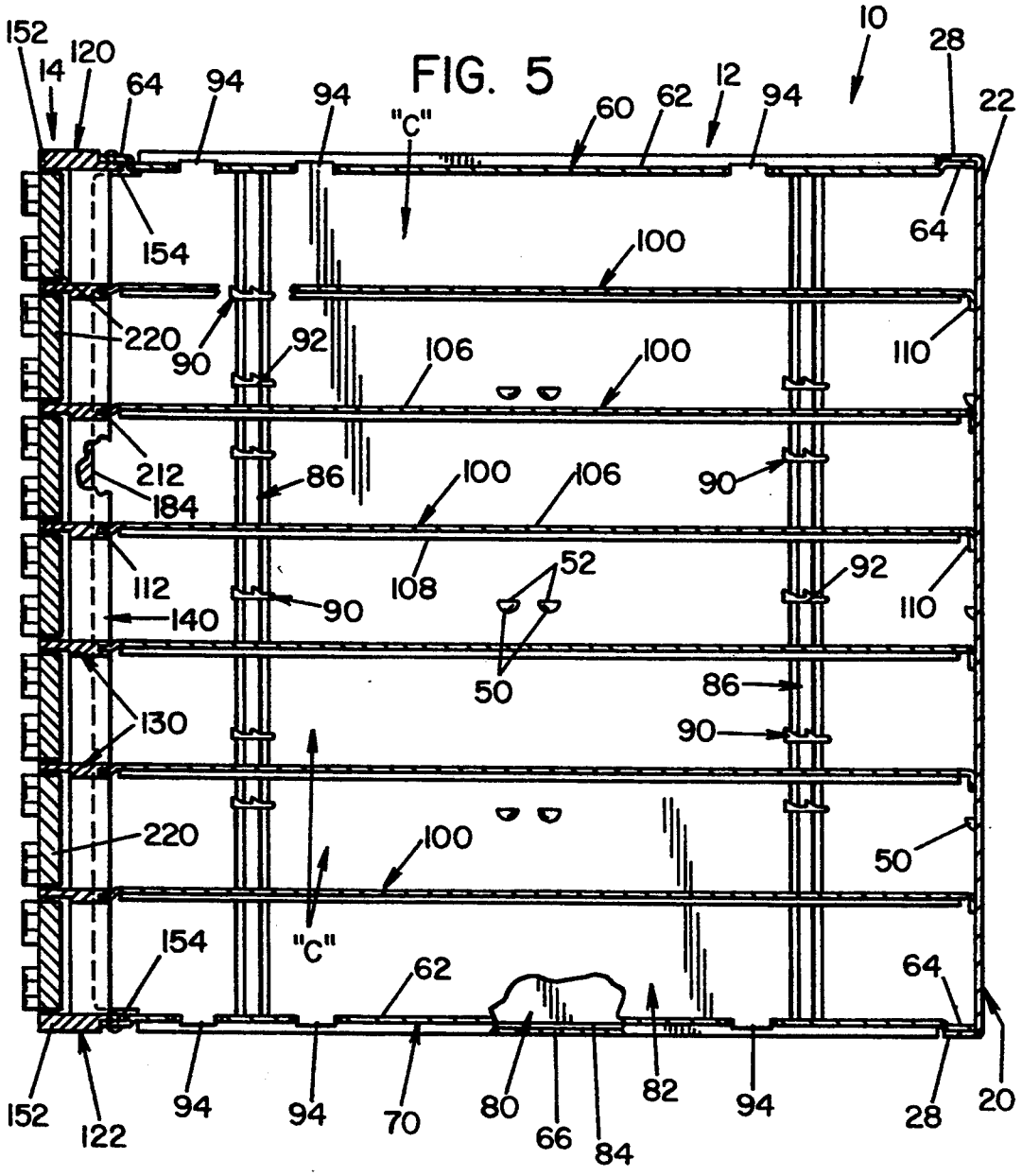
FIG. 5 is an enlarged sectional view taken along lines 5—5 of FIG. 1.

According to the present invention, housing 12 is adapted to receive one of three types of shelves 100, 102, 104 which are designated and shown in FIG. 3A. Shelves 100, 102, 104 are basically similar in structure and differ only in their width. Each shelf is generally a flat sheet formed to have a raised, rectangular central panel 106 and lateral flanges 108 which extend from central panel 106 along the lateral edges of the shelf. As shown in FIG. 3A, flanges 108 are generally parallel to and offset from the surface of raised panel 106. Each shelf 100, 102, 104 includes a down turned rear flange 110 at one end, and an outward projecting front flange 112 at the other end, as best seen in FIG. 5.

Figure 2:
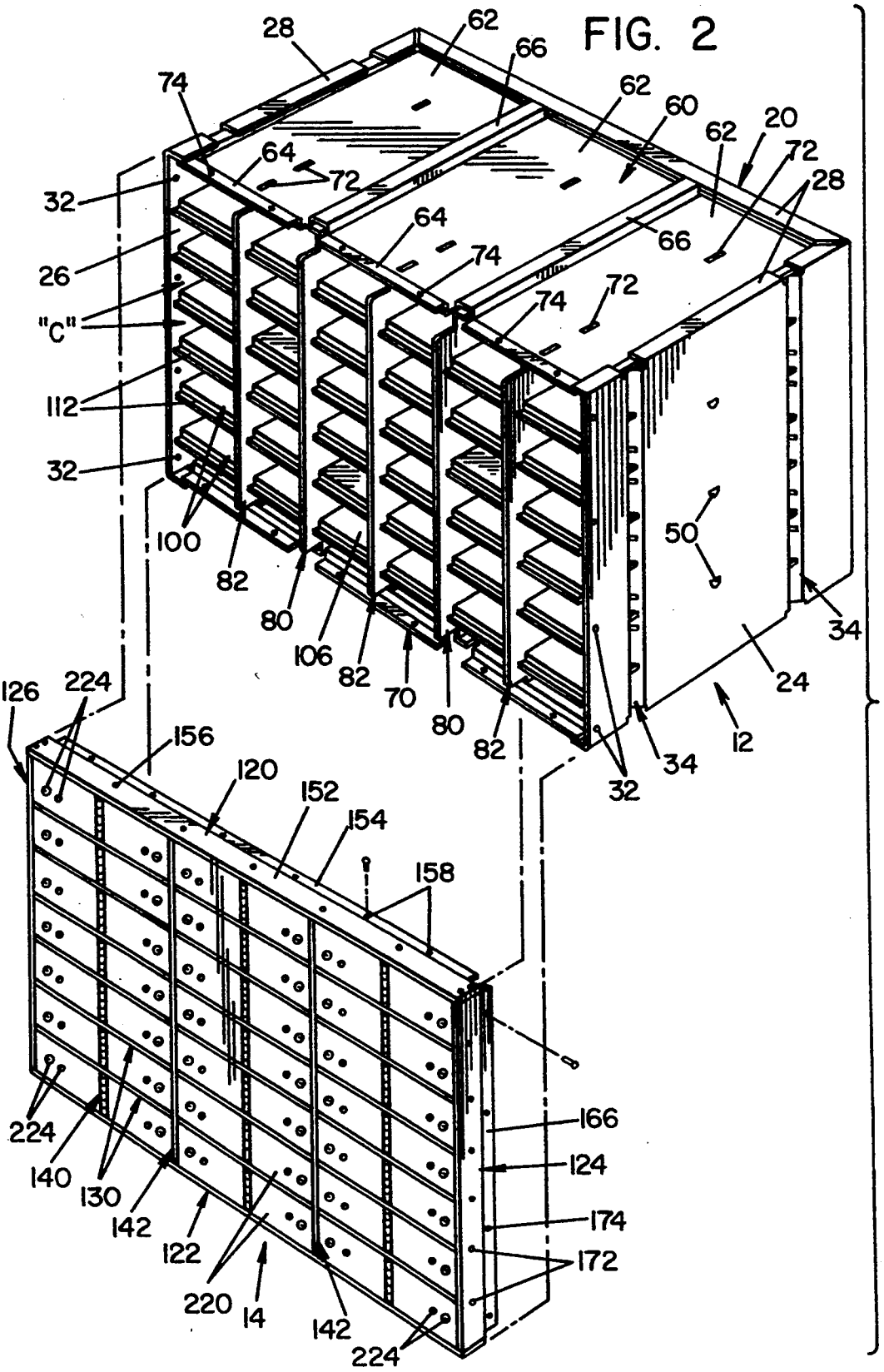
FIG. 2 is an exploded perspective view of the safety deposit box system shown in FIG. 1 showing a door frame assembly separate from a system housing.

Shelf 100, which is the narrowest shelf, is dimensioned to be positioned within the opening defined between the vertical partitions 80 and vertical partitions 82, or in between the opening defined between a vertical partition 82 and side walls 24, 26. In this respect, as is best seen in FIG. 6, flange 108 of shelf is dimensioned to slide within notches 40, 90 formed within corrugations 34, 86 respectively. FIG. 2 shows a security box wherein both vertical partitions 80, 82 are used, and narrow shelves 100 are positioned therebetween. The overall width of shelf 100 (i.e., the dimension across the edges of lateral flanges 108) is approximately one-sixth (1/6) the dimension of the opening defined between side walls 24, 26. In other words, six (6) shelves 100 could be positioned side-by-side in such opening. In the embodiment shown in FIGS. 1 and 2, seven rows of six spaced apart shelves 100 are positioned between side walls 24, 26. In this respect, forty-two (42) compartments designated "C" in the drawings are defined within housing 12.

Intermediate-sized shelf 102 is dimensioned to be positioned in the openings defined between vertical partitions 80 and in the opening defined between vertical partition 80 and side walls 24, 26. In this respect, three shelves 102 could be positioned side-by-side in the space defined between side walls 24, 26. In other words, the overall width (i.e., from the edge of lateral flanges 108) of intermediate-sized shelf 102 is equal to approximately one-third the dimension of the opening defined between side walls 24, 26.

The wide shelf 104 is dimensioned to fit within the opening defined between a centrally located vertical partition 82 and side walls 24, 26. In this respect, the overall width of wide shelf 104 (i.e., between the edges of the lateral flanges 108) is approximately one-half the dimension of the opening defined between side walls 24, 26. Accordingly, two shelves 104 could be positioned side-by-side in such space. As will be described in greater detail below, the particular type and number of shelves used in a specific security box assembly 10 will be based upon the size of the compartments desired to be formed therein.

Referring now to door assembly 14 as shown in FIG. 2, assembly 14 is adapted for use with housing 12 to enclose the front end thereof. Door assembly 14 is basically comprised of a header 120, a sill 122 and opposed jambs 124, 126, which are secured together, preferably by conventional threaded fasteners to form a rectangular frame. In addition to rectangular frame, i.e., header 120, sill 122 and jambs 124, 126, door assembly 14 would also typically include a plurality of door plates 130 or 132 or 134, shown in FIGS. 15A, 15B and 15C, and a plurality of door posts 140 or 142 or 144, best seen in FIGS. 4 and 13A. The number and type of plates 130, 132, 134, as well as the number and type of posts 140, 142, 144 used in a particular door assembly 14 is based upon the configuration of the housing 12 to which it shall be attached (i.e., is based upon the size and number of compartments within housing 12). Header 120, sill 122, jambs 124, 126, plates 130, 132, 134 and posts 140, 142, 144 are preferably aluminum extrusions.

Header 120 and sill 122, best seen in FIG. 5, each include a main body portion 152 which is generally rectangular in cross section and a thinner rearward extending shelf portion 154 which defines a seat or recess along the rear edge thereof. A first set of spaced apart apertures 156 (best seen in FIG. 2) are aligned along the length of header 120 and sill 122 and extend through main body portion 152 thereof. Apertures 156 are located at predetermined positions along header 120 and sill 122 to establish positions for posts 140 or 142 or 144. In this respect, the sparing between these predetermined positions correspond to the spacing established between vertical partitions 80, 82 in housing 12. A second set of spaced apart apertures 158 are provided through the shelf portion 154 of header 120 and sill 122 (best seen in FIG. 2). Apertures 158 are positioned to be in registry with apertures 74 formed in the top wall 60 and bottom wall 70 for the purposes of assembling door frame assembly 14 to housing 12.

Figure 4:
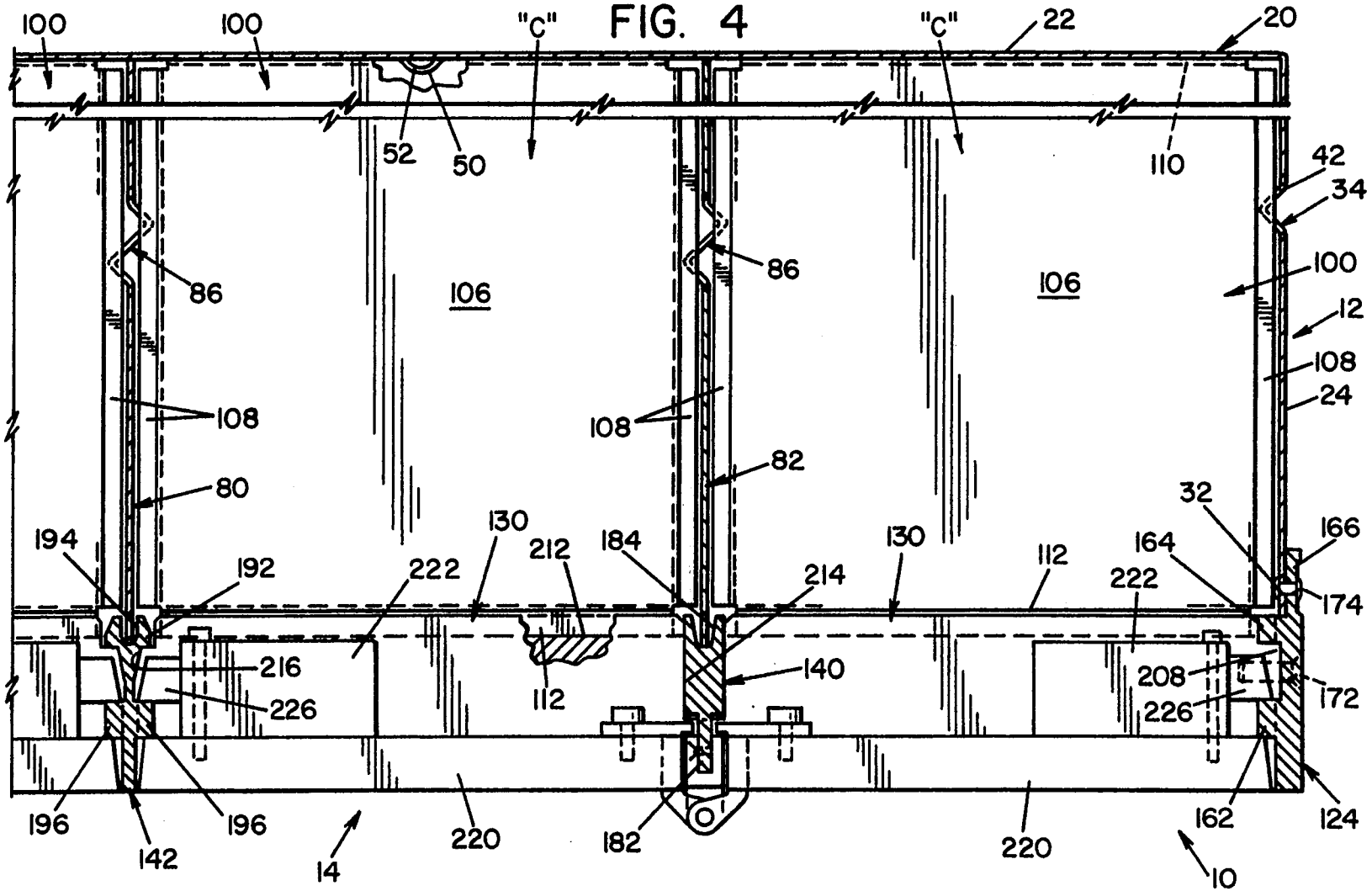
FIG. 4 is an enlarged sectional view taken along lines 4—4 of FIG. 1.

Jambs 124, 126, which connect the ends of header 120 to the ends of sill 122, are generally identical in shape and therefore only jamb 124 shall be described in detail, it being understood that such description applies equally to jamb 126. In this respect, jamb 124, shown in cross section in FIG. 4, is generally rectangular in cross section and formed to include two spaced-apart fibs 162, 164, which fibs 162, 164 are generally parallel to each other which extend along the length of jamb 124. A flange 166 is provided along the rear edge of jamb 124 and together with fib 164 form a rearward facing recessed seat adjacent fib 164. A first set of spaced-apart, aligned apertures 172 is provided along the longitude and length of the main portion of jamb 124. Apertures 172, best seen in FIG. 2, are provided for mounting door plates 130 or 132 or 134 to jambs 124. In this respect, apertures 172 are spaced-apart so as to position door plates 130 or 132 or 134 relative to the shelves within housing 12. A second set of aligned, spaced-apart apertures 174, best seen in FIG. 2, is formed along flange 166 of jamb 124. These apertures 174 are positioned to be in registry with apertures 32 in side walls 24, 26 of housing 12 for the purposes of attaching the door assembly 14 to the housing 12.

Referring now to door posts 140, 142 and 144, three distinct types of posts, i.e., a hinge post 140, a latch post 142, and a combination hinge/latch post 144 are provided for use in the present invention. The type and number of posts used in a particular security box assembly 10 will depend upon the configuration of assembly 10 i.e., upon the number and shape of the individual compartments to be formed therein. In the embodiments shown in FIGS. 1–6, hinge posts 140 and latch posts 142 are utilized. The combination hinge/latch post 144 is utilized in an alternate configuration of the security box assembly 10 as will be described in greater detail below.

The hinge post 140, shown in cross section in FIG. 4, is generally rectangular in cross section and includes a planar door hinge mounting section 182 which projects outward from the front end of hinge post 140 and extends along the entire length thereof. Hinge mounting section 182 includes a plurality of mounting apertures (not shown) for the purpose of mounting hinge plates on a door thereto. A rearward facing groove 184 extends along the length of hinge post 140. Groove 184 is dimensioned to receive the edge of a vertical partition 80 or 82, as shown in FIG. 4.

Latch post 142, shown in cross section in FIG. 4, is generally a flat bar having an enlarged portion 192 along one edge thereof. Enlarged portion 192 has a groove 194 formed therein to receive the edge of a vertical partition 80 or 82. Rectangular fibs 196 project from both sides of latch post 142 and extend along the length thereof. These fibs 196 define locking surfaces as will be described in greater detail below.

Referring now to FIG. 13A, a combination hinge/latch post 144 is shown in cross section. Like latch post 142 and hinge post 140, combination hinge/latch post 144 is preferably an extrusion which is formed to have a rearward facing groove 202 extending along the back edge thereof to receive the edge of a vertical partition 80. The opposite edge is formed as a fiat plate 204. A rectangular fib 206 (which provides a locking surface) extends from one side of hinge/latch post 144 and extends along the length thereof.

The number, type and position of the post or posts used in a particular security box assembly 10 will be based upon the desired number and shape of compartments to be formed therein. In the embodiment shown in FIGS. 1–6, alternately spaced hinge posts 140 and latch posts 142 are provided within the door assembly 14.

Figures 15A, 15B, 15C:
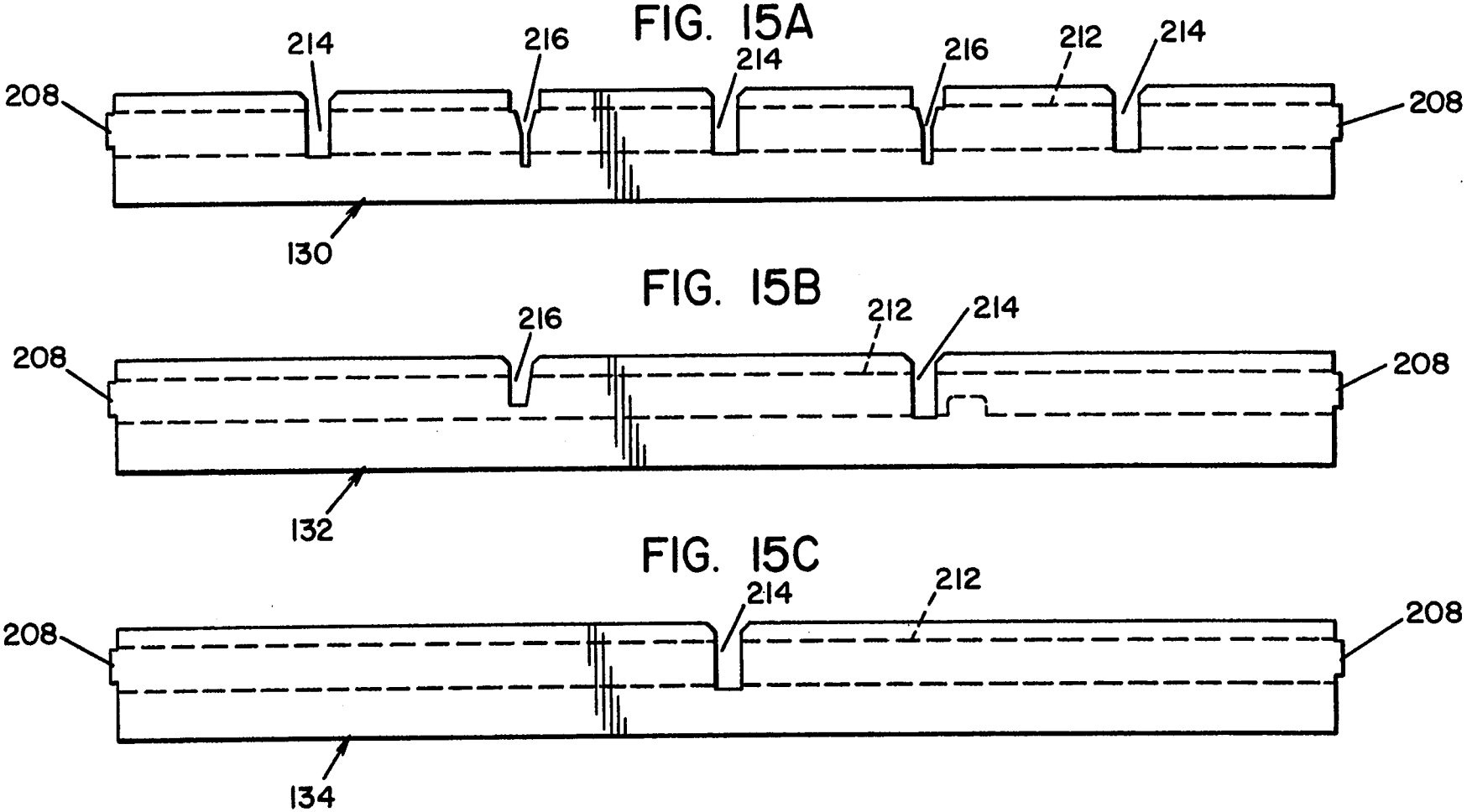
FIG. 15A–15C are top, plan views of three types of door frame plates which may be utilized to a specific type door frame.
Figure 16A:
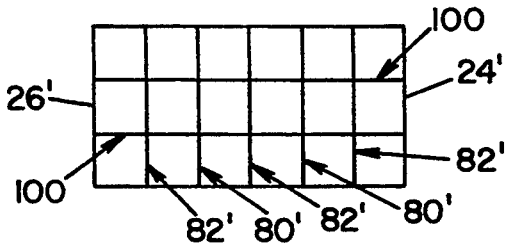
FIGS. 16A–16E are schematic representations of safety deposit box systems and the different compartment sizes which may be formed therefrom, illustrating alternate embodiments of the present invention.
Figure 16B:
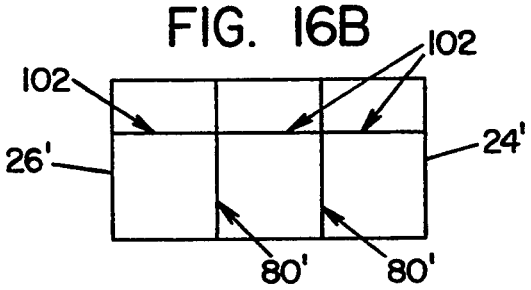
Figure 16C:
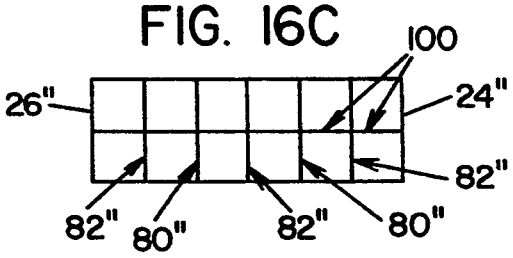
Figure 16D:
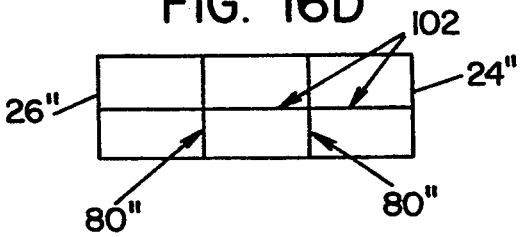
Figure 16E:
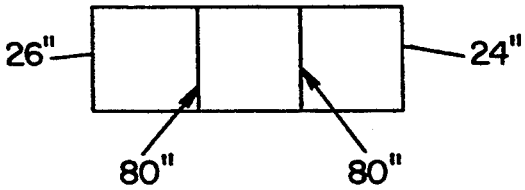

Referring now to FIGS. 15A, 15B and 15C, three (3) types of door plates 130, 132, 134, which may be utilized in a safe deposit box structure 10 according to the present invention, are shown in plan view.

Door plates 130, 132, 134 are dimensioned to span, and be attached to, jambs 124, 126. In this respect, door plates 130, 132, 134 are elongated members, each having the same length and each similar in cross-section, which cross-section is best seen in FIG. 5. The distal end of each door plate 130 or 132 or 134 includes a generally rectangular tab 208. Tab 208 is dimensioned to be received in a slot defined between ribs 162, 164 of jambs 124, 126, as best seen in FIG. 4.

In the embodiment shown in FIGS. 1–6, door plates 130 are utilized. Door plates 130 are oriented to be generally parallel to sill 122 and header 120. Door plates 130, as shown in cross section in FIG. 5, are generally rectangular in shape and are formed to generally be extensions to shelves 100 within the housing 12. In this respect, the rear edge of plates 130 includes an elongated slot 212, shown in FIG. 15B, which extends along the length of plate 130. Slot 212 is dimensioned to receive front flange 112 on the front edge of shelf 100 such that the upper surface of plate 130 and the corresponding upper surface of the shelves 100 are aligned and coplanar. Because door plates 130 are designed to traverse and interlock with hinge posts 140 and latch post 142, notches 214, 216 are formed at pre-determined locations along the rear edge of door plate 130, notch 214 being dimensioned to receive hinge post 140, and notch 216 being dimensioned to receive latch post 142. In this respect, door plate 130 is notched to receive three hinge posts 140 and two latch posts 142. FIGS. 15B and 15C show alternate door plates 132 and 134, which may be used to modify the configuration, i.e., the size and number of compartments "C" in a security box 10. As seen in FIG. 15B, door plate 132 is formed to have two notches 214, 216 dimensioned to receive a hinge post 140 and a combination hinge/latch post 144, respectively. FIG. 15C shows a door plate 15C having a central notch 214 formed therein to receive a hinge post 140. In all other respects, door plates 132, 134 are similar to the previously described door plate 130, the exception being the location, number and type of notches, i.e., 214, 216 formed therein. In this respect, the general cross section, overall length and shape of the door plates 130, 132, 134 are similar and are as that shown in FIG. 5.

Security box doors 220 are provided for attachment to either hinge post 140 or combination hinge/latch post 144 to enclose each compartment "C" formed within a security box assembly 10. As would be appreciated, door 220 is dimensioned to be received within the opening defined by a compartment "C". Each door 220 includes a lock housing 222 and two key pads 224 which extend through door 220 into lock housing 222. A movable latch 226 extends from the lock housing 222 and is operable to engage a rib 162, 196, 206 on either a jamb 124, hinge post 140 or combination hinge/latch post 144 respectively, as illustrated in FIG. 4, which shows a safety deposit box using jamb 124 and hinge post 140.

Figure 12A:
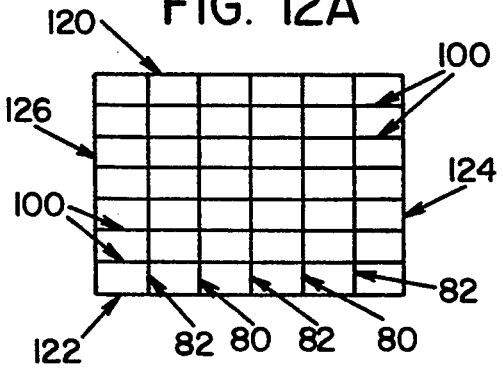
FIGS. 12A–12F are schematic representations of different safety deposit box systems, showing the different compartment sizes, may be formed according to the present invention.
Figure 12B:
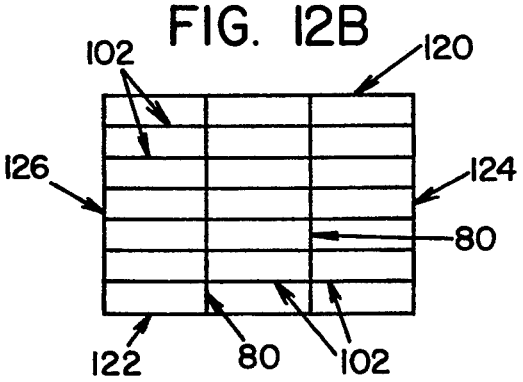
Figure 12C:
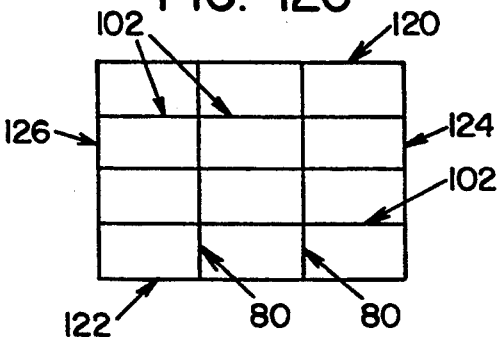
Figure 12D:
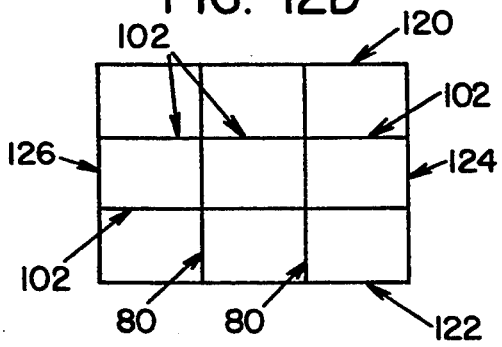
Figure 12E:
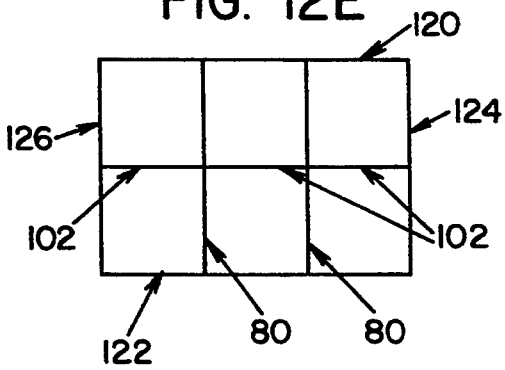

In the embodiment shown in FIGS. 1–6, a security box 10 assembly having forty-two (42) compartments "C" is shown. Accordingly, door assembly 14 would have forty-two (42) doors 220 dimensioned to close the openings defined in the security box assembly 10. The general configuration of the safe deposit box assembly 10 heretofore described, lends itself to construction of security box assemblies having compartments "C" of different sizes. For example, FIGS. 12A–12F schematically show configurations of safe deposit box assemblies 10 which can be created using the basic components heretofore described. In this respect, FIG. 12A is a schematic representation of a safe deposit box assembly shown in FIGS. 1–6, while FIGS. 12B–12F show alternate safe deposit box assemblies. In the embodiments shown in FIG. 12B–12E, vertical partitions 82 are omitted to produce wider compartments "C". By positioning shelves 102 in specific locations, the height of each compartment "C" may be varied. In this respect, notches 40 formed in the side walls 24, 26 and in vertical partitions 80 are positioned such that shelves 102 may be positioned to define seven (7), four (4), three (3), or two (2) stacked compartments as respectively shown in FIGS. 12B, 12C, 12D and 12E. In the embodiments shown in FIG. 12B–12E, a hinge post 140 and a combination hinge/latch post 144 are used. This arrangement is best illustrated in FIGS. 13 and 13A which generally shows in detail the embodiments schematically illustrated in FIG. 12C.

Figure 14:
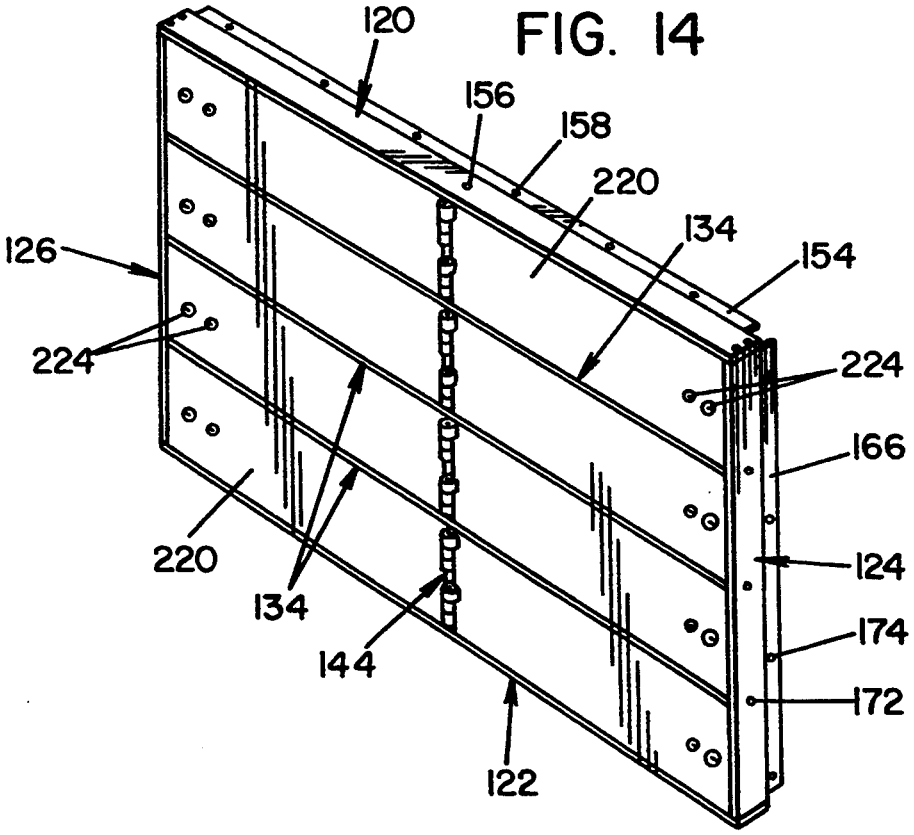
FIG. 14 is a perspective view of a door frame assembly showing doors used for enclosing compartments which are dimensioned to store "teller trays"
Figure 12F:
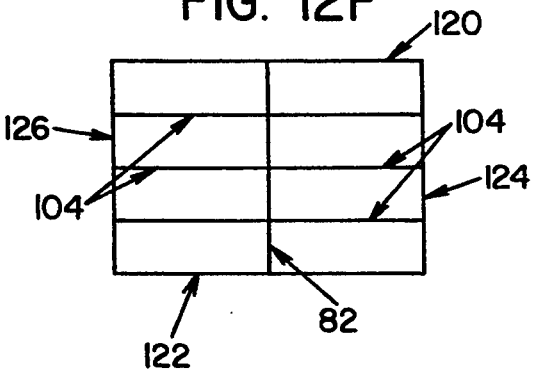

FIG. 12F shows a security box case assembly 10 which defines a wide, short compartment for storage of a "teller drawer" (drawers used by bank tellers). In this configuration, the vertical partitions 80 are omitted during construction of housing 12 and a single vertical partition 82 is centrally located within housing 12. Shelves 104 are positioned within housing 12 to define eight (8) short, wide compartments "C." As shown in FIG. 14, door assembly 14 for such a case assembly would include a central hinge post 140 and door plates.

These compartments "C" are dimensioned to receive "teller drawers" typically used by bank tellers. According to the present invention, indentations 50 are primarily provided to provide additional support for shelves 104 which are used to support such "teller drawers." In this respect, such a "teller drawers" could typically hold a substantial amount of coins, which results in considerable weight being exerted on shelf 104. This weight and the width of such shelves 104 may cause such shelves to sag. Indentations 50 provide additional support as best illustrated in FIG. 11. According to the present invention, indentations 50 are positioned such that indentation support surface 52 is slightly below corresponding notch support surfaces 42, 92 of corresponding notches 40, 90. In other words, indentations 50 are positioned at specific elevations in relation to the notches 40, 90, which would support shelves 104 in the security box assembly configured as schematically shown in FIG. 12F. The general position of indentations 50 relative to notches 90 is best seen in FIG. 5. In the embodiment shown, indentations 50 are preferably positioned such that indentation support surface 52 is approximately 0.030 inches below notch support surfaces 42, 92.

The present invention thus provides a basic design, and specific number of basic components which can easily and quickly be configured into plurality of different safe deposit box structures, wherein each safe deposit box structure may have different sized storage compartments. More importantly, the present invention lends itself to quick, easy construction of such safe deposit box structures. In this respect, the use of an adhesive or spotwelding to secure top wall 60 and bottom wall 70 to frame 20, and to secure vertical partitions 80 to top wall 60 and bottom wall 70 eliminates the cost and expense of mechanically fastening same. Once the basic housing 12 is assembled, the addition of the vertical partitions 82 and the positioning of shelves 100 or 102 or 104 therein is easily accomplished by merely snapping tabs 94 on vertical partitions 82 into place in slot 72 in top wall 60 and bottom wall 70 and by sliding flanges 108 of an appropriate shelf 100 or 102 or 104 in notches 40 or 90 at the desired position to define the particular sized compartment openings. As indicated above, the present invention has been designed to facilitate the fabrication of a plurality of generally standard sized security box compartments. In this respect, the notches 40, 90 within side walls 24, 26 and vertical partitions 80, 82 are positioned to enable the openings defined within the housing 12 to be divided into either seven (7), four (4), three (3) or two (2) horizontal spaces. Likewise, vertical partitions 80, 82 are dimensioned to vertically divide the opening of housing 12 compartment into either two (2), three (3) or six (6) equally sized side-by-side vertical spaces. Thus, as can be seen from FIGS. 12A–12F, a plurality of different sized compartments can be easily fabricated using the components heretofore described.

Still further, while the present invention provides a safe deposit box structure which is easily manufactured and quickly assembled, the resulting structure is fairly rigid due to the interlocking nature of the components. In this respect, lateral flanges 108 on shelves 100, 102, 104 are dimensioned to approximate the height of the ridges 34, 88 such that when each shelf 100 or 102 or 104 is positioned within housing 12, lateral shifting of shelves 100 or 102 or 104 is minimized by the raised partitions 106 prohibiting lateral movement of shelves 100, 102, 104 by abutting the ridges 34, 88, as best illustrated in FIG. 6. Likewise, the configuration of posts 140, 142, 144 and door plates 130, 132, 134 (i.e., each having a slot or groove along the rear edge thereof to receive the leading edges of the shelves and partitions respected, locks such selves and partitions in place when the door assembly 14 is attached to housing 12).

Figure 17A:
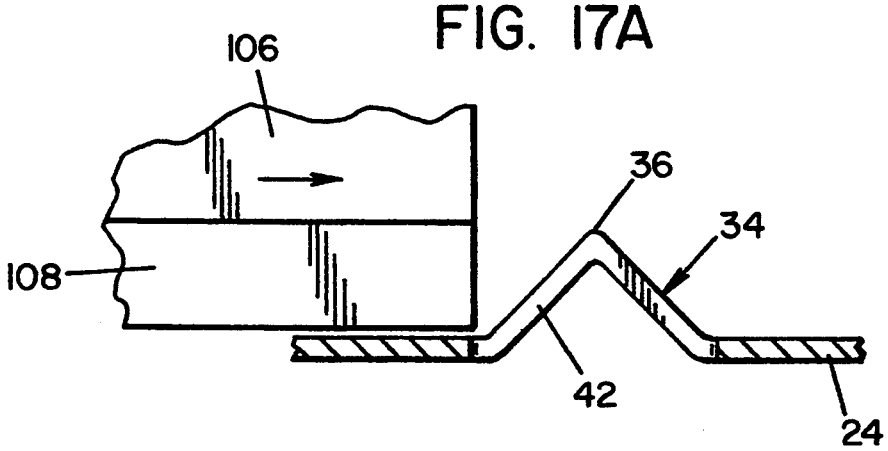
FIGS. 17A and 17B are enlarged sectional views through one side wall showing how components of the safe deposit box system may be deformed after assembly to provide a more rigid structure.
Figure 17B:
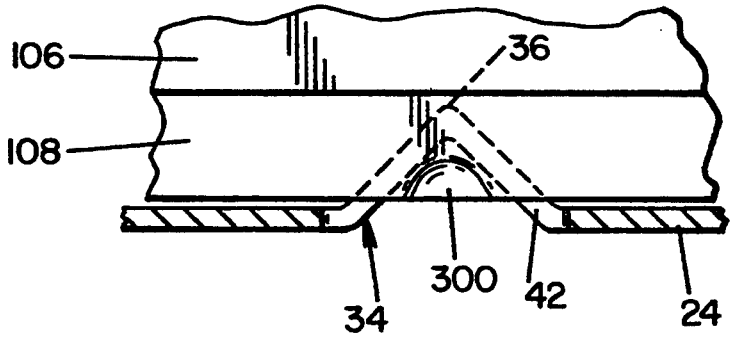
Figure 17C:
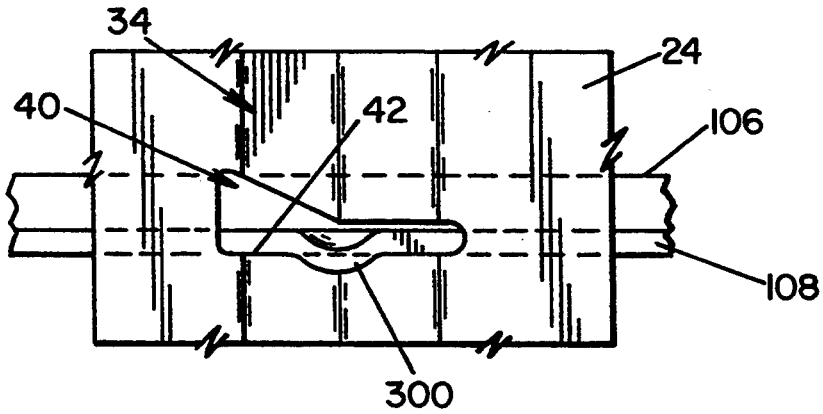
FIG. 17C is an elevational view of the shelf and side wall shown in FIGS. 17A and 17B.

Still further, the assembled structure may be also strengthened by "locking" the shelving in place within the side walls 24, 26 and vertical portions 80, 82. The shelves may be "locked" in place by deforming the portion of flanges 108 which extend through ridges 34 in side walls 24, 26. As best illustrated in FIGS. 17A–17C, flange 108 of a shelf is positioned within a notch 34 in sidewall 24. The portion of flange 108 extending through notch 34 may be deformed by means of a hammer and punch to create a deformation 300 which locks the shelf in position relative to the side wall 24. In addition to "locking" the shelves to side walls 24, 26, such shelves may likewise be locked to vertical portions 80, 82 in a similar fashion.

The present invention thus provides a safe deposit box structure 10, which is easily and quickly assembled, and which may be modified to create structures having different sized storage compartments. Modifications and alterations to the safe deposit box structure heretofore described will occur to others upon a reading and understanding of the present application. For example, FIGS. 16A–16D, schematically illustrate safe deposit box structures having side walls 24', 26', 24'', 26'' and vertical partitions 80', 82', 80'', 82'', which are dimensioned to be three-quarter ($\frac{3}{4}$) or one-half the height of the corresponding components shown in FIGS. 1–6. In this respect, smaller (i.e. shorter) safe deposit box structures utilizing many of the basic components and features described above can also be created. It is intended that all such modifications and alterations be included insofar as they come within the scope of the patent as claimed or the equivalents thereof.

Thus, having described the present invention, the following is claimed:

1. A safety deposit box storage structure comprising:

a casing formed from continuous metal sheet, said casing having a back wall and spaced apart side walls, at least one inwardly projecting ridge extending along the inner surface of said side walls, a top wall and a bottom wall secured to said casing to form a box structure having an open front end, locating means on said top and bottom walls defining a plurality of vertical divider positions for creating different numbers of equally spaced openings between said side walls, at least one single sheet, generally flat vertical divider disposed between and parallel to said side walls, said vertical divider having an upper end and a lower end for attachment respectively to said locating means on said top and bottom walls, at least one corrugation formed in said vertical divider extending from said upper end to said lower end of said vertical divider, said corrugation having a ridge projecting from each side of said divider, a plurality of spaced-apart slots formed in said ridges, said slots being generally parallel to said top and bottom wall and located to define a plurality of horizontal divider positions for creating different numbers of openings between said top wall and said bottom wall, a plurality of horizontal dividers having lateral edges dimensioned to be received in said slots, said at least one vertical divider and said horizontal dividers defining compartments within said box structure to receive a security box, and a door frame fixedly connectable to said open front end of said casing, said door frame including a plurality of lockable doors equal in number to the number of compartments.

2. A safety deposit box storage structure as defined in claim 1 wherein said door frame includes a header, a sill and opposed jambs, said door frame being dimensioned to permit connection of said jambs to said side walls and said header and sill with said top wall and bottom wall respectively.

3. A safety deposit box storage structure as defined in claim 1 wherein said door frame includes at least one vertical post extending between said header and said sill, said at least one vertical post positioned to be in alignment with said at least one vertical divider when said door frame is connected with said housing.

4. A safety deposit box storage structure as defined in claim 1 wherein said top wall and said bottom wall are secured to said frame by an adhesive.

5. A safety deposit box storage structure as defined in claim 1 wherein said door frame is comprised of a header, a sill, opposed jambs, said header, sill and jambs being fixedly connected together into a structurally rigid frame configuration, a plurality of spaced-apart posts extending between, and fixedly connected to said header and said sill, and at least one plate extending between and fixedly mounted to said jambs.

6. A safety deposit box storage structure as defined in claim 1 wherein:

said casing, said top wall and said bottom wall define a generally rectangular cavity, and said slots in said ridges are positioned such that said horizontal dividers divide said cavity into a plurality of generally equal rectangular sections.

7. A safety deposit box storage structure as defined in claim 6 wherein said slots in said ridges are positioned such that said horizontal dividers divide said cavity into two (2) generally equal rectangular sections.

8. A safety deposit box storage structure as defined in claim 6 wherein said slots in said ridges are positioned such that said horizontal dividers divided said cavity into three (3) generally equal rectangular sections.

9. A safety deposit box storage structure as defined in claim 6 wherein said slots in said ridges are positioned such that said horizontal dividers divided said cavity into four (4) generally equal rectangular sections.

10. A safety deposit box storage structure as defined in claim 6 wherein said slots in said ridges are positioned such that said horizontal dividers divided said cavity into seven (7) generally equal rectangular sections.

11. A safety deposit box storage structure as defined in claim 1 wherein said casing, said top wall and said bottom wall define a generally rectangular cavity, and said storage structure includes two vertical dividers, the ends of which are secured to said top wall and said bottom wall by adhesive, said two vertical dividers being spaced apart from each other and from said side wails of said casing to divide said cavity into three (3) generally equal rectangular sections.

12. A safety deposit box storage structure as defined in claim 11 wherein said storage structure includes five (5) spaced-apart vertical dividers extending from said top wall to said bottom wall, said five (5) spaced-apart vertical dividers dividing said cavity into six (6) generally equal rectangular sections.

13. A safety deposit box storage structure as defined in claim 12 wherein said storage structure includes five (5) spaced-apart vertical dividers extending from said top wall to said bottom wall, said five (5) spaced-apart vertical dividers dividing said cavity into seven (7) generally equal rectangular sections.

14. A safety deposit box storage structure as defined in claim 13 wherein said storage structure includes five (5) spaced-apart vertical dividers extending from said top wall to said bottom wall, said five (5) spaced-apart vertical dividers dividing said cavity into eight (8) generally equal rectangular sections.

15. A safety deposit box storage structure as defined in claim 14 wherein said storage structure includes five (5) spaced-apart vertical dividers extending from said top wall to said bottom wall, said five (5) spaced-apart vertical dividers dividing said cavity into nine (9) generally equal rectangular sections.

16. A safety deposit box storage structure as defined in claim 15 wherein said storage structure includes five (5) spaced-apart vertical dividers extending from said top wall to said bottom wall, said five (5) spaced-apart vertical dividers dividing said cavity into ten (10) generally equal rectangular sections.

17. A safety deposit box storage structure as defined in claim 1 wherein said slots in said ridges have a flared opened end facing said open front end of said box structure.

18. A safety deposit box storage structure as defined in claim 3 wherein said header, sill, jambs, posts and plates are aluminum extrusions.

19. A safety deposit box storage structure as defined in claim 18 wherein said door frame is secured to said box structure by mechanical fasteners.

20. A safety deposit box storage structure as defined in claim 1 wherein said top wall and said bottom wall are secured to said frame by spot welding.

* * * * *